US006402080B1

(12) United States Patent
Blankenhorn

(10) Patent No.: US 6,402,080 B1
(45) Date of Patent: Jun. 11, 2002

(54) ARRANGEMENT AND METHOD FOR WINDING THREADS ONTO BOBBINS WITH RANDOM CROSSWINDING

(75) Inventor: Peter Blankenhorn, Gerstetten (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/548,653

(22) Filed: Apr. 13, 2000

(30) Foreign Application Priority Data

Apr. 14, 1999 (DE) ..... 199 16 669

(51) Int. Cl.[7] ..... B65H 54/38

(52) U.S. Cl. ..... 242/477.6; 242/477.8; 242/477.3

(58) Field of Search ..... 242/477.6, 477.8, 242/483.5, 477.3, 477.1, 477.4

(56) References Cited

U.S. PATENT DOCUMENTS 3,241,779 A * 3/1966 Bray et al. ..... 242/477.6
3,799,463 A * 3/1974 Peckinpaugh ..... 242/477.6
4,296,889 A * 10/1981 Martens ..... 242/18.1
5,033,686 A * 7/1991 Rebsamen ..... 242/476.7
5,381,676 A * 1/1995 Shibata et al. ..... 66/149 R
5,469,149 A * 11/1995 Binner et al. ..... 340/677
5,676,322 A * 10/1997 Stahlecker ..... 242/473.7
5,713,528 A * 2/1998 Pohn ..... 242/43.1
5,803,383 A * 9/1998 Boekels ..... 242/477.6
6,003,806 A * 12/1999 Simon ..... 242/477.6

FOREIGN PATENT DOCUMENTS

DE 43 37 891 A1 5/1995

* cited by examiner

*Primary Examiner*—Donald P. Walsh
*Assistant Examiner*—Joseph Rodriguez
(74) *Attorney, Agent, or Firm*—Crowell & Moring LLP

(57) ABSTRACT

In the case of an open-end spinning machine, threads are wound onto bobbins with random crosswinding. A so-called antipatterning is hereby necessary, which is usually achieved by so-called wobbling. During wobbling, the speed of the winding shaft and/or the speed of the traverse gearing is periodically altered. A first variable speed motor is provided for driving the winding shaft and a second variable speed motor is provided for driving the traverse gearing. A control device controls the variable speed motors and sets the wobble curves. The constant delivery speed of the yarn withdrawal shaft, on which a speed transmitter is disposed, serves as the master speed for the control device.

10 Claims, 2 Drawing Sheets

36
18
19
C
B
3
20
16
h
3
17
35
29
14
6
4
30
4
9
27
S2
W2
X2
t
to
n
n2
S1
W1
X1
t
to
n
n1
nL
t
n
34
26
25
28
31
32
33

ARRANGEMENT AND METHOD FOR WINDING THREADS ONTO BOBBINS WITH RANDOM CROSSWINDING

BACKGROUND AND SUMMARY OF THE INVENTION

This application claims the priority of German application 199 16 692.2, filed in Germany on Apr. 14, 1999, the disclosure of which is expressly incorporated by reference herein.

When threads or yarns are wound onto bobbins, for example in open-end spinning machines, the respective thread is moved to and fro tranversely to its running direction. This to and fro motion of the thread is called traversing. A characteristic measure for the transverse speed is the double stroke count, that is one motion forward, one motion back.

In winding devices, in which the bobbin is driven by a friction roller at its periphery, a so-called random crosswinding occurs. In the production of such random crosswindings, there is the risk that from time to time so-called patterns or surfaces occur. Such patterns or surfaces arise then when per double stroke of the yarn guide of the traversing device, complete bobbin revolutions take place.

In the area of these patterns or surfaces, a plurality of wound layers are disposed directly one over the other, whereby the bobbin obtains a rib-like appearance. Such patterns or surfaces later impair the running off properties of the bobbin, in that they lead to end breaks or possibly to a defective bobbin. Such patterns or surfaces can also lead to an erratic placement of the bobbin on its friction roller and thus to possible damage of the bobbin.

It is known to effect an antipatterning in that the double stroke count is constantly changed periodically or aperiodically within a predetermined narrow time limit. In the case of automatic winding machines with a single drive for each bobbin, the antipatterning can be applied exactly then when the risk of a pattern directly threatens. When the bobbins, as is the case in open-end spinning machines, are driven centrally by a winding shaft extending in machine longitudinal direction, it must be considered that the fullness of each individual bobbin differs greatly from winding station to winding station. This is overcome in that the antipatterning is applied even when it is not necessary. This occurs by means of continuous so-called wobbling, whereby the speed of the winding shaft and/or the traversing speed of the yarn guide rod are constantly varied, i.e. the actual constant nominal speed of the winding shaft and/or the traversing speed is overriden by a periodic, for example, sinusoidal interference function, the so-called wobble curve.

In a known device in German published patent application 43 37 891, on which the present invention is based, the individual threads are fed to the bobbins from a delivery device with constant delivery speed. A winding shaft serves as a drive for the bobbins, on which shaft is arranged a plurality of friction rollers, on which the individual bobbins are disposed and driven on their peripheries. A traverse gearing serves to provide the traverse motion of the yarn guiding rod. A plurality of yarn guides, placed at the bobbins and moving to and fro, are arranged on the yarn guiding rod. Variable speed motors are each provided for the drive of the winding shaft and also for the traverse gearing. The variable speed motors are controlled by a controlling device, which presets wobble curves for each of the two variable speed motors in order to prevent patterning. By means of the wobble curves, the otherwise constant nominal speeds of the variable speed motors are periodically altered. The wobble curves of the two variable speed motors are synchronous with regard to their antipatterning periods, but in regard to their antipatterning disturbances (amplitudes) are contrasting, so that unacceptable thread tension can be avoided during wobbling. Preferably, it can be further provided that the antipatterning period and also the antipatterning disturbance can be varied by a preset mean value, whereby the antipatterning is even more effective.

It is an object of the present invention to improve the known device with regard to its drives and antipatterning.

This object has been achieved in accordance with the present invention in that a speed transmitter, arranged on a delivery shaft of the delivery device, transmits a delivery speed as the master speed to the control device, which in turn transmits the respective variable nominal speed to the speed regulators arranged at the variable speed motors, which nominal speeds arise from the override of the respective constant nominal speeds and the respective wobble curves.

In a further development of the above mentioned prior art, the control device of the present invention is thus not only coupled with the variable speed motors of the winding shaft and the traverse gearing, but also with a master shaft speed transmitter. If, for whatever reason, speed deviations occur at the master shaft, these will be transmitted directly by means of the speed transmitter to the control device, which can then adapt exactly the preset speeds for the winding shaft and the traverse gearing accordingly. In the control device, the values for the antipatterning disturbances (amplitudes) and the antipatterning periods of the wobble curves are also set, and these values are transmitted further as set to both the speed regulators, preferably frequency convertors.

If the device is applied in open-end spinning machines, then the delivery shaft is in this case a yarn withdrawal shaft, which, under the action of a pressure roller, withdraws the spun thread from the respective spinning rotor and feeds it to the bobbin. This withdrawal shaft can be coupled by means of a mechanical gearing directly with a draw-in shaft, by means of which the fiber material to be spun, for example a sliver, is fed. The withdrawal shaft can, as before, be electrically connected with the central drive motor of the individual spinning rotors.

The antipatterning period is frequently based not on the speed of the traverse gearing but rather on the double stroke of the traversing yarn guide. An advantageous antipatterning can be achieved when the antipatterning period amounts to 8 to 40 double strokes. As for the antipatterning disturbance, a variation of the speeds of between 1% to 15% has proven to be sufficient.

Other advantages, features, and details of the invention will be found in the description below in which a number of embodiments of the invention are described in detail with reference to the drawings. The features referred to in the claims and the specification may be important to the invention individually or in any combination.

DETAILED DESCRIPTION OF THE DRAWINGS

Figure 1:
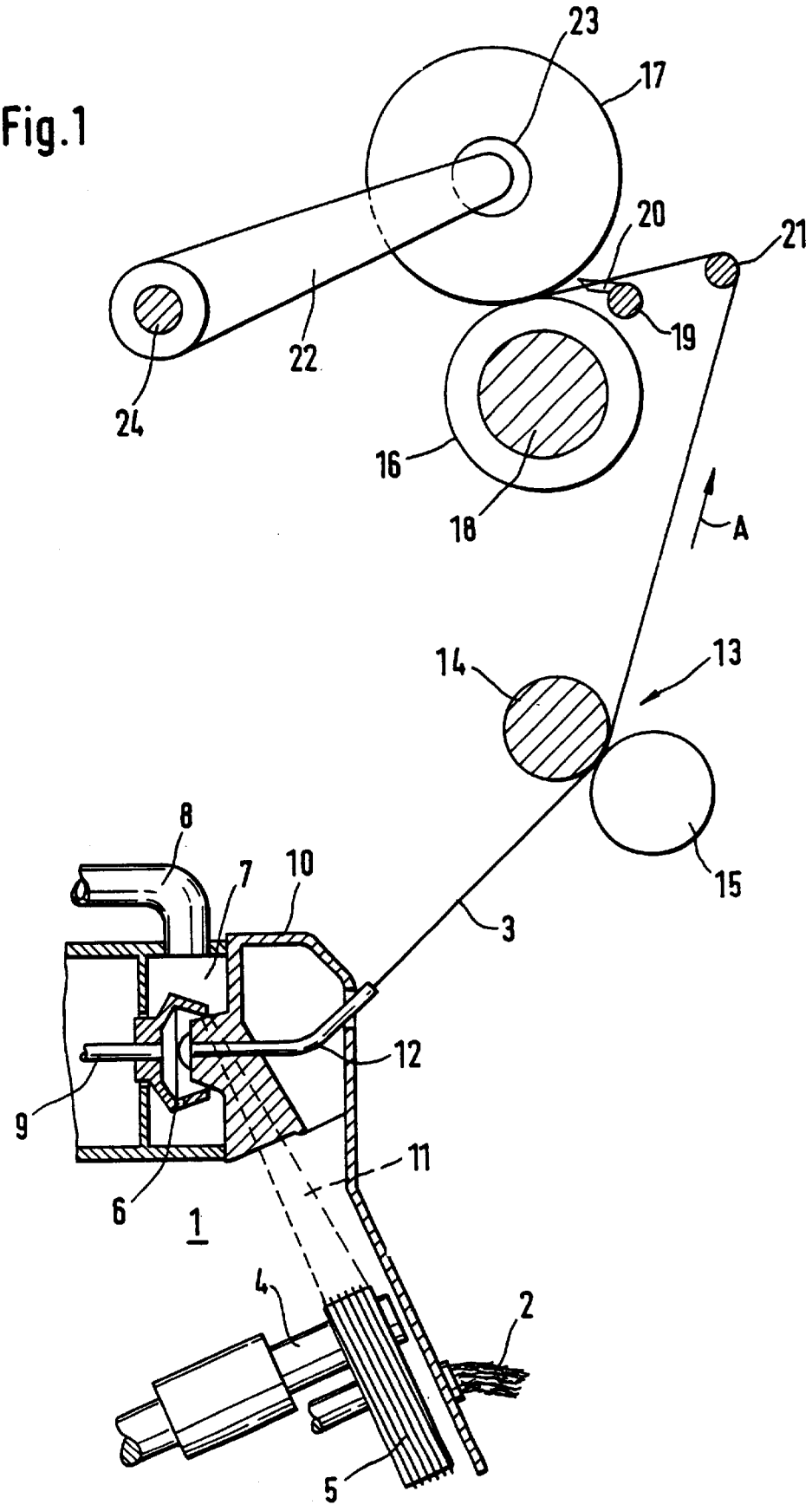
FIG. 1 is a partly sectional schematic side view of a very simplified representation of an open-end spinning aggregate, constructed according to preferred embodiments of the present invention.

The simplified version of the spinning station 1 shown in FIG. 1 is one of a plurality of identical spinning stations arranged adjacently to one another on each machine side of an open-end rotor spinning machine. In these spinning stations 1, a thread 3 is spun in a known way from a fed sliver 2.

Each spinning station 1 comprises a feed roller 4 for feeding the sliver 2, an opening roller 5 for opening the sliver 2 to single fibers as well as a spinning rotor 6, in which the single fibers are collected together to form a fiber ring and spun to form the thread 3. The spinning rotor 6 rotates in a vacuum chamber 7, which is connected to a suction conduit 8. The shaft 9 connected to the spinning rotor 6 is supported and driven in a way not shown here.

During operation, the vacuum chamber 7 is closed by means of a cover 10, which in a known way comprises a fiber feed channel 11 for feeding the single fibers into the spinning rotor 6, as well as a yarn withdrawal channel 12 for withdrawing the spun thread 3.

The thread 3 is withdrawn during operation in withdrawal direction A by means of delivery device 13, which is in the form of a delivery roller pair. This comprises a delivery shaft 14 extending along in machine longitudinal direction, and a pressure roller 15 per spinning station 1. The withdrawn thread 3 reaches a winding roller in the form of a friction roller 16, on which the bobbin 17 to be filled is disposed. The friction roller 16, connected to a winding shaft 18 extending along in machine longitudinal direction, causes the bobbin 17 to rotate, so that under the co-action of a traversing yarn guide 20, a bobbin 17 with random crosswindings can be made. The yarn guides 20 of all spinning stations 1 are arranged on a traversing yarn guide rod 19 extending along in machine longitudinal direction.

A deflecting rod 21 is arranged upstream of the friction roller 16 for the purpose of equalizing tension.

During operation, the rotating bobbin 17 is held in a bobbin holder 22, which comprises on both sides of the bobbin 17 a bobbin board 23. The bobbin holder 22 is swivellable around a swivel axle 24 affixed to the machine, so that the bobbin holder 22, with increasing fullness of the bobbin, can pivot upwards from the friction roller 16, whereby the bobbin 17 is, of course, constantly disposed on the friction roller 16 and is driven thereby.

As already described, in the case of bobbins 17 with random crosswinding, patterning occurs in particular when complete bobbin rotations take place per double stroke of the thread guide 20. For this reason, the following antipatterning, described below with the aid of FIG. 2, is provided.

Figure 2:
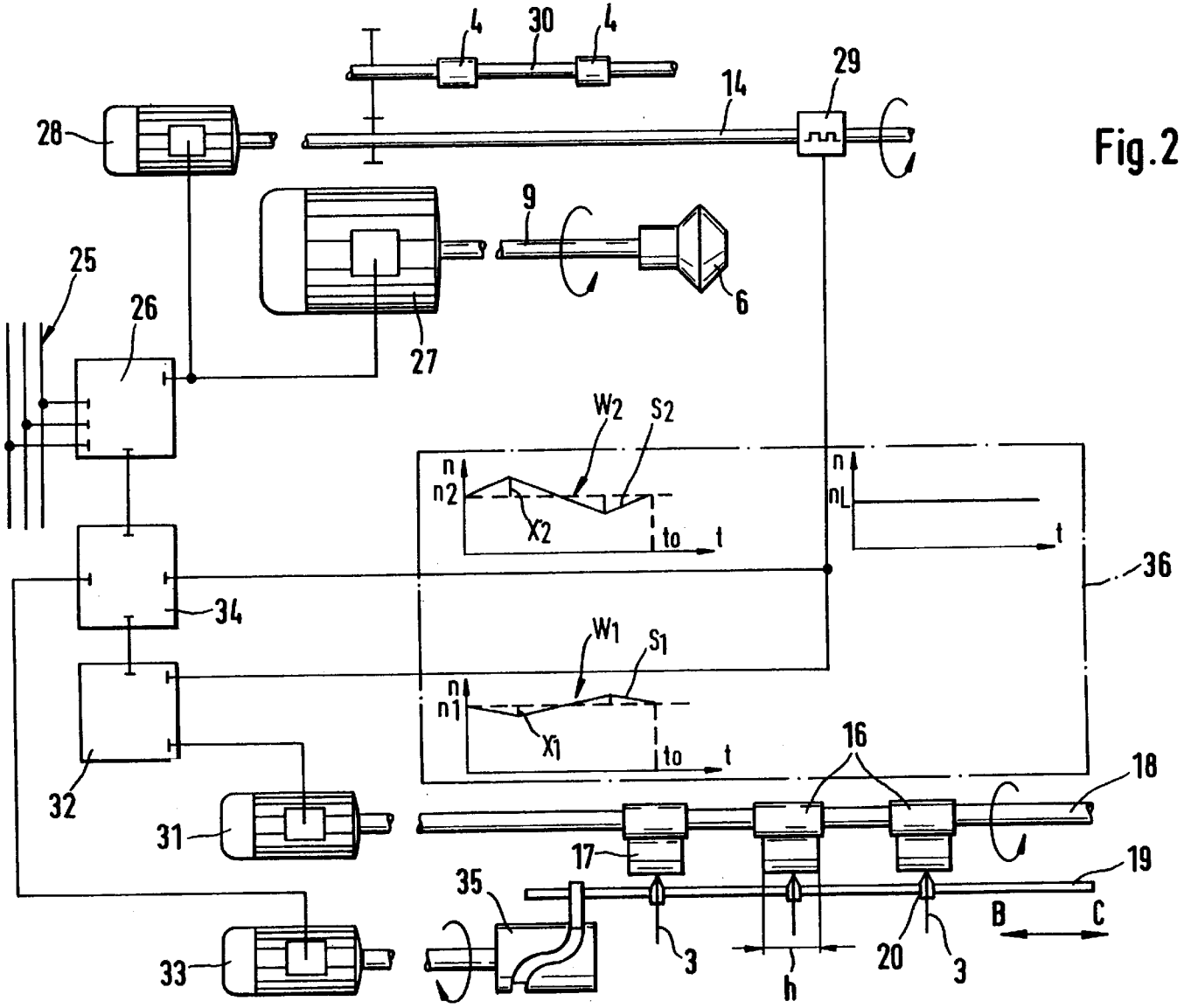
FIG. 2 is a schematically shown drive scheme for the openend spinning aggregate with particular attention to the control device, constructed according to preferred embodiments of the present invention.

In the schematic representation shown in FIG. 2, some of the components already described with the aid of FIG. 1 can be seen. Here, however, attention is expressly drawn to the fact that a drive scheme is involved, and that the individual components in FIG. 2 are not shown in their actual geometrical arrangement.

A draw-in shaft 30 is indicated at the top of FIG. 2, which shaft 30 serves the drive of a plurality of feed rollers 4. A spinning rotor 6 can also be seen, whose shaft 9 is driven to rotate. Further, the delivery shaft 14 is also shown. In the lower area of FIG. 2 the winding shaft 18 is shown, on which a plurality of friction rollers 16 is arranged, on which the individual bobbins 17 are disposed. A yarn guide rod 19 comprising the yarn guides 20 is arranged at the winding shaft 18. The yarn guides 20 traverse according to the traverse directions B and C, whereby the stroke of these traverse motions are denoted with h, which corresponds essentially to the length of the bobbin 17. The threads 3 fed to the yarn guides 20 can also be seen.

According to FIG. 2 a three-phase network 25 is provided, to which a frequency convertor 26 is directly connected. This frequency convertor 26 controls a drive motor 27 acting as a main drive motor, which drive motor 27 is in the form of a three-phase asynchronous motor and which serves the drive of the shafts 9 of the individual spinning rotors 6. This is effected in a known way by means of tangential belts (not shown), which are disposed on the shafts 9 and extend in machine longitudinal direction. A drive motor 27 with approximately 30 kw is provided for each machine side.

The frequency convertor 26 controls further a drive motor 28 for the delivery shaft 14, which serves for the withdrawal of the threads 3 from the spinning rotors 6 and which is in the form of a master shaft in the present drive scheme. The drive motor 28 is also a three-phase asynchronous motor of, for example, 7.5 kW.

A speed transmitter 29 is arranged on the delivery shaft 14, which is decisive for the drive control, in a way to be described below.

The draw-in shaft 30, as already mentioned, is coupled with the delivery shaft 14 by means of a mechanical gearing, as the delivery shaft 14 and the draw-in shaft 30 must run exactly in a predetermined speed ratio to one another, so that no count fluctuations of the spun threads 3 occur.

A first variable speed motor 31 is provided for the winding shaft 18, which motor 31 takes the form of a three-phase asynchronous motor with an output of, for example, 2.4 kw. A speed regulator 32 is arranged upstream of this first variable speed motor 31, the speed regulator 32 being a frequency convertor.

A second variable speed motor 33 is provided for the traverse motion of the yarn guide rod 19, which motor 33 is also in the form of a three-phase asynchronous motor with an output of, for example, 2.4 kW.

A second speed regulator 34 is also arranged upstream of this second variable speed motor 33 also in the form of a frequency convertor. The second variable speed motor 33 drives the primary shaft of a traverse gearing 35 and thus also the traversing rod 19.

The two variable speed motors 31 and 33 are connected electrically to one another by means of a control device 36. This control device 36, here the machine computer, is only schematically indicated by means of a dot-dash square.

The delivery speed $n_L$ of the delivery shaft 14 from the speed transmitter 29 is constant during a spinning operation. However, this speed $n_L$ can take on varying values from batch to batch. The delivery speed $n_L$ is given as the master speed into the control device 36, as shown in the dot-dash square located top right in the diagram. In this diagram, the speed n is outlined over the time t, and the constant delivery speed $n_L$ is seen.

The control device 36 in turn then transmits given values for both the speed regulators 32 and 34 and thus for both the variable speed motors 31 and 33.

As shown in the dot-dash square in the bottom left-hand corner, the control device 36 presets for the first variable speed motor 31 a first nominal speed $n_1$. Involved here is the constant base speed of the winding shaft 18, which is then overriden by a wobble curve $w_1$, which is described below.

As shown in the dot-dash square in the top left-hand corner, the control device 36 presets for the second variable speed motor 31 a second nominal speed $n_2$involved here is the at first constant primary speed of the traverse gearing 35. The second nominal speed $n_2$ is then also overriden by a second wobble curve $w_2$, which is described below.

As can be seen from the comparison of the wobble curves $w_1$ and $w_2$ over one another, the preset antipatterning periods $t_0$ are each identical. It is possible to permit each of the antipatterning periods $t_0$ to fluctuate by means of a random generator (here aperiodically wobbling has also been mentioned), the momentary antipatterning period $t_0$ must, however, in the case of both wobble curves $w_1$ and $w_2$, be identical, so that no yarn tension fluctuations occur.

In the case of the first wobble curve $w_1$ a first antipatterning disturbance (amplitudes) $x_1$ is present. In the case of the second wobble curve $w_2$, there is accordingly a second antipatterning disturbance $x_2$. As can be seen, both antipatterning disturbances $x_1$ and $x_2$ are different and are directed against one another, that is, when the antipatterning disturbance $x_2$ is positive, the antipatterning disturbance $x_1$ is negative. This is necessary because during traversing the respective so-called traverse triangle of the thread 3 would lead otherwise to different thread lengths and thus to possible inadmissable thread tensions.

The control device 36 transmits to the first speed regulator 32 and thus the first variable speed motor 31 a first variable set speed $s_1$, which arises from the override of the first nominal speed $n_1$ and the first wobble curve $w_1$. Accordingly, the control device 36 transmits to the second speed regulator 34 and thus to the second variable speed motor 33 a second set speed $s_2$, which is also variable and which arises from the constant second nominal speed $n_2$ and the overridden second wobble curve $w_2$.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus for winding threads onto bobbins with crosswinding, comprising:

a delivery device including a delivery shaft operable to control a delivery speed of threads, a speed transmitter operable to generate a delivery shaft speed signal, a winding shaft carrying a plurality of friction rollers for driving respective bobbins, a yarn guide rod driven by traverse gearing and carrying a plurality of yarn guides for guiding yarn to the respective bobbins, a first variable speed motor driving the traverse gearing, a second variable speed motor driving the winding shaft, and a control unit operable to control the variable speed motors while changing their speeds from respective nominal speeds according to respective wobble curves to thereby avoid undesired bobbin thread winding patterns, wherein the delivery shaft speed signal from the speed transmitter is continuously fed to the control unit and is used by the control unit to set the nominal speeds of the variable speed motors, thereby assuring reliable antipatterning control of said variable speed motors during varying thread delivery speeds.

2. Apparatus according to claim 1, wherein the wobble curves of the variable speed motors are synchronous with respect to one another with regard to their antipatterning period and are opposite with respect to one another with regard to their antipatterning disturbance.

3. Apparatus according to claim 2, wherein the antipatterning period of the wobble curve amounts to eight to forty double strokes of the yarn guides.

4. Apparatus according to claim 2, wherein the antipatterning disturbance amounts to between 1 and 15% of the respective nominal speed.

5. Apparatus according to claim 3, wherein the antipatterning disturbance amounts to between 1 and 15% of the respective nominal speed.

6. A method of controlling the winding of thread on bobbins with crosswinding in a system comprising:

a delivery device including a delivery shaft operable to control a delivery speed of threads, a speed transmitter operable to generate a delivery shaft speed signal, a winding shaft carrying a plurality of friction rollers for driving respective bobbins, a yarn guide rod driven by traverse gearing and carrying a plurality of yarn guides for guiding yarn to the respective bobbins, a first variable speed motor driving the traverse gearing, a second variable speed motor driving the winding shaft, and a control unit operable to control the variable speed motors while changing their speeds from respective nominal speeds according to respective wobble curves to thereby avoid undesired bobbin thread winding patterns;

said method comprising continuously generating and feeding the delivery shaft speed signal from the speed transmitter to the control unit and using the delivery shaft speed signal in the control unit to set the nominal speed of the variable speed motors, thereby assuring reliable antipatterning control of said variable speed motors during varying thread delivery speeds.

7. Method according to claim 6, wherein the wobble curves of the variable speed motors are synchronous with respect to one another with regard to their antipatterning period and are opposite with respect to one another with regard to their antipatterning disturbance.

8. Method according to claim 7, wherein the antipatterning period of the wobble curve amounts to eight to forty double strokes of the yarn guides.

9. Method according to claim 7, wherein the antipatterning disturbance amounts to between 1 and 15% of the respective nominal speed.

10. Method according to claim 8, wherein the antipatterning disturbance amounts to between 1 and 15% of the respective nominal speed.

* * * * *